United States Patent [19]

Haruch

[11] Patent Number: 4,540,124

[45] Date of Patent: Sep. 10, 1985

[54] ROTARY DISC ATOMIZER

[75] Inventor: James Haruch, Clarendon Hills, Ill.

[73] Assignee: Spraying Systems Co., Wheaton, Ill.

[21] Appl. No.: 439,858

[22] Filed: Nov. 8, 1982

[51] Int. Cl.[3] ..... B05B 3/10

[52] U.S. Cl. ..... 239/223

[58] Field of Search ..... 239/214.11, 214.17, 239/223, 224, 700–703

[56] References Cited

U.S. PATENT DOCUMENTS

| | | | |
|---|---|---|---|
| 809,046 | 1/1906 | Collins | 239/224 X |
| 1,219,994 | 3/1917 | Patten | 239/224 |
| 1,558,586 | 10/1925 | Bradley et al. | 239/224 X |
| 2,220,275 | 11/1940 | Preston . | |
| 2,369,216 | 2/1945 | Crisp . | |

FOREIGN PATENT DOCUMENTS

| | | | |
|---|---|---|---|
| 1104171 | 6/1981 | Canada . | |
| 112155 | 9/1964 | Czechoslovakia | 239/224 |
| 292940 | 7/1928 | United Kingdom | 239/223 |
| 1161560 | 8/1969 | United Kingdom | 239/224 |
| 1581192 | 12/1980 | United Kingdom . | |
| 1590650 | 6/1981 | United Kingdom . | |
| 2078550 | 1/1982 | United Kingdom . | |

*Primary Examiner*—Andres Kashnikow

*Attorney, Agent, or Firm*—Leydig, Voit, Osann, Mayer & Holt, Ltd.

[57] ABSTRACT

A rotary disc atomizer adapted to generate relatively precisely controlled, uniformly sized spray droplets whether mounted in a vertical position or in significantly tilted positions. The atomizer includes a power driven rotary disc having a tapered fluid dispensing surface, a liquid supply whirl chamber in coaxial relation to the disc, and a liquid feed arrangement adapted to tangentially feed liquid into the whirl chamber so that it is rapidly moved in a relatively uniform thin sheet about the chamber and then exits in an annular uniform flow centrally onto the dispensing surface of the disc. The centrifical forces of the swirling feed liquid permit the atomizer to be mounted in substantially tilted positions without effecting the uniformity of the spray output or droplet size.

19 Claims, 7 Drawing Figures

ROTARY DISC ATOMIZER

DESCRIPTION OF THE INVENTION

The present invention relates generally to liquid sprayers, and more particularly, rotary disc, controlled droplet atomizer-type sprayers which find particular application in agricultural useage.

Conventional pressure-type liquid sprayers waste a large percentage of the chemicals that are applied because the droplets produced by such sprayers are of uneven size. Larger droplets tend to run off or miss the plant parts or insects being treated and smaller droplets tend to be lost to airborne drift or evaporation. Recent developments in rotary disc-type atomizers have greatly improved the efficiency of liquid chemical application by permitting the generation of selectively controlled, relatively uniform sized droplets. In such atomizers, the liquid is introduced near the center of a rotating disc and centrifugal forces move the liquid across the surface of the disc in the form of a thin film of liquid. As the film reaches the edge of the disc, the liquid is torn into ligaments to form droplets by the high peripheral velocity imparted to the liquid. By controlling the liquid feed rate and the rotational speed of the disc, the resulting spray can be controlled to produce the desired droplet size for a particular application. Spraying with such rotary disc atomizers has been found to substantially improve efficiency in chemical utilization, greatly reduce water requirements, and minimize undesirable drift.

It is customary to mount such rotary disc atomizers on a transport boom with the axis of the rotating disc vertically oriented so that the spray mist is circumferentially emitted from the disc in a horizontal direction and then floats downwardly onto the plant foliage under treatment. Since many crops, such as soy beans, have foliage that forms a substantially uninterrupted upper canopy, the spray from such rotary disc atomizers often will come to rest on top of the foliage without reaching insects or leaves below. To overcome such problem, it has been the practice to mount the sprayer with the axis of the rotating disc tilted from the vertical such that the spray emitted from one side of the atomizer is more forcefully directed downwardly into the foliage. However, when conventional rotary disc-type atomizers have been mounted in such tilted position—and particularly when mounted at a significant angle to the vertical—feed liquid introduced to the rotating disc often tends to flow unevenly to one side of the disc adversely affecting the uniformity of the spray output and droplet size, and in some instances, drips or leaks from the sprayer causing chemical waste and possible plant damage.

It is an object of the present invention to provide a rotary disc atomizer that is adapted for more versatile and precisely controlled spraying of liquids.

Another object is to provide a rotary disc atomizer as characterized above which generates relatively precisely controlled, uniform sized droplets whether mounted in a vertical position or in significantly tilted positions. A related object is to provide a rotary disc atomizer that permits such tilted mounting without undesirable drippage or leakage of the liquid and without affecting the uniformity of the spray output and droplet size.

A further object is to provide a rotary disc atomizer of the foregoing type that permits elimination of premixing of chemicals prior to spraying. In this regard, it is a related object to provide an atomizer that enables simultaneous mixing of chemicals during the spraying operation.

Other objects and advantages of the invention will become apparent as the following description proceeds taken in conjunction with the accompanying drawings, in which.

Figure 1:
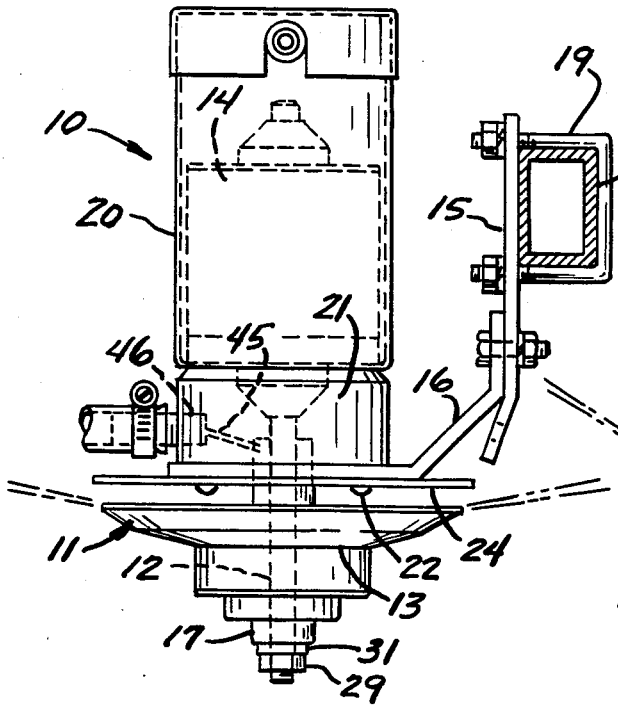
FIG. 1 is a side elevational view of a rotary disc atomizer embodying the present invention.

While the invention is suceptible of various modifications and alternative constructions, certain illustrative embodiments thereof have been shown in the drawings and will be described below in more detail. It should be understood, however, that there is no intention to limit the invention to the specific forms disclosed, but, on the contrary, the intention is to cover all modifications, alternative constructions, and equivalents falling within the spirit and scope of the invention.

Referring now more particularly to FIG. 1 of the drawings, there is shown an illustrative rotary disc atomizer 10 embodying the present invention. The atomizer 10 includes a rotary disk 11 mounted on the depending drive shaft 12 of an electric motor 14. The atomizer 10 in this instance is shown supported by mounting flanges 15, 16 from a horizontal support boom 18. The mounting flange 15 is secured to the boom 18 in vertical depending relation by a C-clamp 19 and the flange 16 is angle shaped so that when mounted on a vertical portion of the flange 15, such as illustrated in FIG. 1, the motor 14 is supported with its drive shaft 12 vertically disposed. The illustrated motor 14 is contained within a casing 20 that in turn is supported by a mounting block 21 fixed to the flange 16 by bolts 22. A circular splash plate 24 having a diameter slightly larger than the diameter of the rotary disc 11 in this case is mounted on the underside of the mounting flange 16 in closely spaced relation above the rotary disc. The drive shaft 12 extends through the block 21, mounting flange 16 and splash plate 24 such that upon energization of the motor 14, the disc 11 may be rotated at a desired speed. Typically an agricultural sprayer apparatus would include a plurality of such atomizers and the respective drive motors would be battery powered. It will be appreciated that while in the illustrated embodiment the rotary disc is mounted directly on the motor drive shaft, alternatively the disc could be mounted on a pulley or gear driven shaft that in turn is appropriately powered.

The rotary disk 11 in the illustrated embodiment is formed of a two-part construction for ease of manufacture, including a cone 13 and a mounting hub 17 appropriately fixed to the underside thereof. The upper side of the cone 13 is formed with a conical recess, in this instance having a taper of about 10 degrees with respect to the horizontal, which defines a liquid dispersing surface. To facilitate controlled outward movement of a liquid film along the tapered disc surface during high speed spinning of the disc, as will become apparent, the dispensing surface preferably is formed with a plurality of closely spaced radial grooves 25. As is known in the art, the angle of taper of the cone surface and the number of grooves formed therein may vary depending upon the size of the rotary disc, the liquid feed rates, and the range of operating speeds for the disc.

Figure 3:
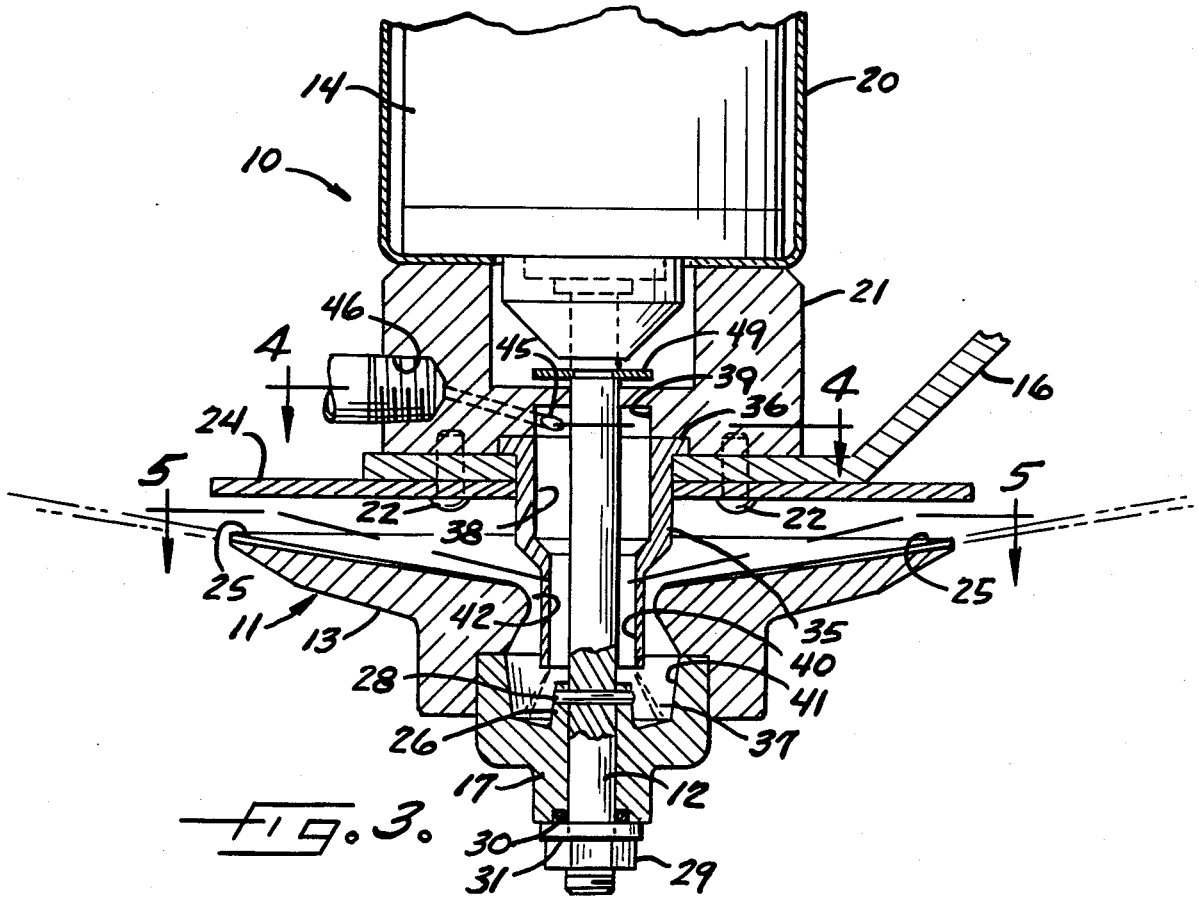
FIG. 3 is an enlarged fragmentary section of the rotary disc atomizer shown in FIG. 1.

For securing the disc 11 to the drive motor shaft 12, the disc hub 17 is formed with an upstanding annular wall 26 having opposed apertures for receiving a drive pin 28 that extends transversely through the motor shaft 12 (FIG. 3). The lower end of the drive shaft 12 extends through the hub 17 and is threaded to receive a fastening nut 29. An O-ring 30 in this instance provides a seal between the lowermost end of the hub 17 and shaft 12, and a washer 31 is interposed between the nut 29 and hub 17. In accordance with the invention, means are provided for uniformly feeding liquid to the rotary disc in a manner that permits either vertical or substantial tilted mounting of the atomizer, without adversely effecting the uniformity of the spray output or droplet size, and without undesirable dripping or leakage of the feed liquid. More particularly, means are provided for tangentially feeding liquid into a liquid supply whirl chamber of the atomizer such that the liquid is rapidly moved in a relatively, thin uniform sheet about the chamber and discharges therefrom in a uniform sheet onto the center of the rotating disc. To this end, in the illustrated embodiment, a sleeve 35 is mounted in coaxial spaced relation about the driveshaft 12 for defining a fixed whirl chamber. The sleeve 35 extends through appropriate appetures in the mounting flange 16 and splash plate 24 and is formed with an outwardly extending flange 36 at its upper end that is interposed between the mounting block 21 and mounting flange 16 so as to be held in proper coaxial position. The sleeve 35 in this instance is formed with a first relatively large diameter whirl chamber section 38 that communicates at its upper end with an equal diameter counter bore section 39 of the mounting block that encloses the top of the first whirl chamber section. The sleeve 35 further is formed with a second, relatively, smaller diameter whirl chamber section 40 that extends downwardly into an annular fluid supply chamber 41 centrally formed in the top of the rotary disc 11. The rotary disc supply chamber 41 has a relatively large diameter bottom portion surrounding the lower end of the sleeve 35 and communicates upwardly through a relatively small diameter annular discharge opening 42 in the top of the disc through which the fixed sleeve 35 passes.

Figure 4:
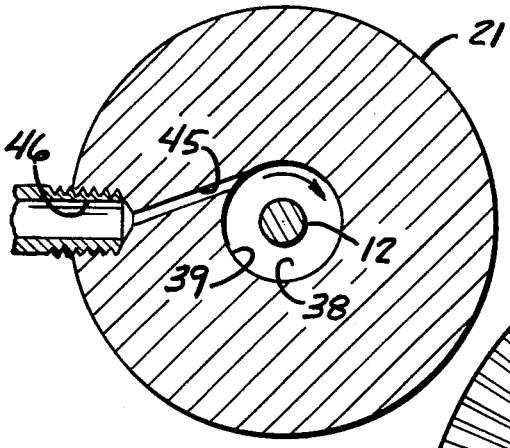
FIG. 4 is a horizontal section taken in the plane of line 4—4 in FIG. 3.
Figure 5:
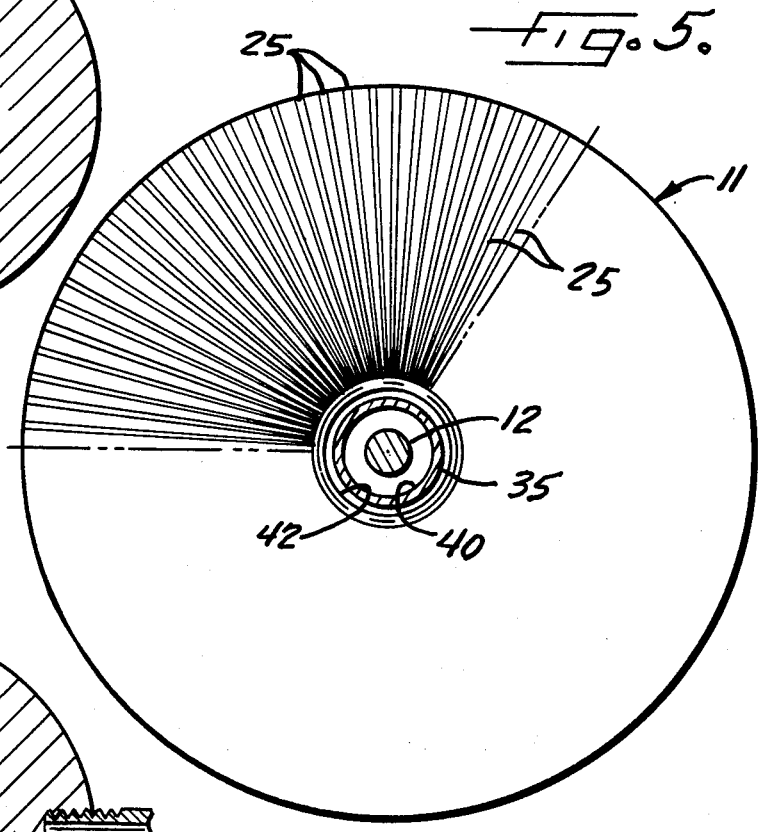
FIG. 5 is a section taken in the plane of line 5—5 in FIG. 3.

In carrying out the invention, the mounting block 21 is formed with a fluid passage 45 that extends from an inlet port 46 into tangential relation with an upper portion of the fixed whirl chamber section 38, as depicted in FIGS. 3 and 4. The tangential inlet passage 45 preferably extends downwardly from the inlet port 46 at a relatively small angle to the horizontal, such as about 20 degrees as illustrated, although the passage 45 may be disposed horizontally or at angles up to as much as 60 degrees below the horizontal. Pressurized liquid introduced into the fluid supply passage 45 from the inlet port 46 will tangentially enter near the top of the whirl chamber section 38, causing a swirling movement to be imparted to the liquid in the chamber. As the liquid continues to be directed into the whirl chamber from the supply passage 45 the liquid will form a relatively thin, substantially uniform hollow sheet about the walls of the upper chamber section, and by virture of the axial and tangential velocity of the moving liquid, will move downwardly through the lower reduced diameter whirl chamber section 40 and discharge from the lower end thereof in the form of an outwardly directed uniform hollow cone, such as depicted at 37 in FIG. 3, which is directed into the annular chamber 41 of the rotary disc 11. The liquid directed into the annular disc chamber 41 will continue to swirl about the walls of that chamber while in a substantially uniform annular sheet, assisted by the further centrifical forces of the rotating disc. When the sheet of liquid reaches a depth as governed by the annular discharge opening 42 of the disc, the liquid will flow in an uninterrupted annular sheet onto the center of the tapered disc surface. The liquid will then proceed to flow in a generally outward direction as a substantially thin film disposed uniformly about the disc surface, resulting in the discharge of spray droplets of substantially similar size.

It will be appreciated that because the liquid flow through the fixed sleeve 35 and annular disc chamber 41 onto the disc surface is in the form of a hollow core annular sheet that is radially spaced from the driveshaft 12 extending through the sleeve 35 and annular chamber 41, the driveshaft remains substantially out of contact with the feed liquid. Hence, it is unnecessary to provide a liquid tight seal between the mounting block 21 and the driveshaft 12, which would otherwise increase the power requirements necessary in driving the rotary disc. In the illustrated embodiment only a splash washer 49 is mounted on the driveshaft 12 immediately above the mounting block driveshaft appeture for impeding possible inadvertent spashing of liquid in the direction of the motor.

Figure 2:
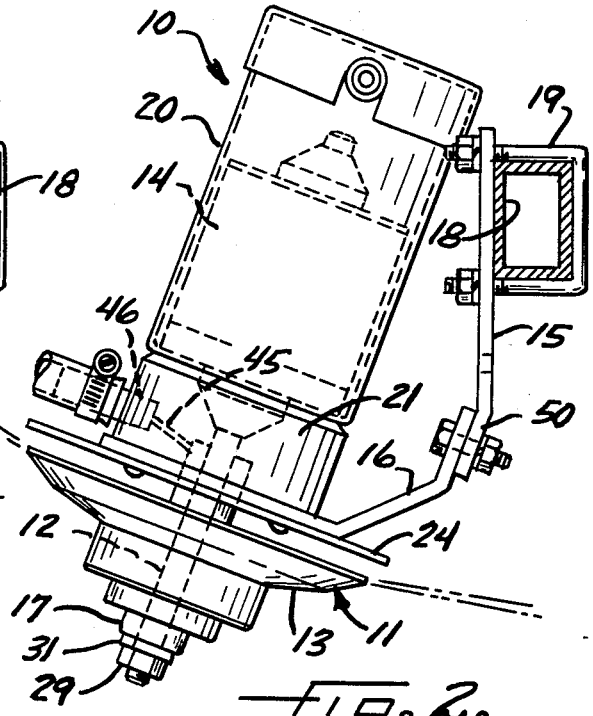
FIG 2 is a side elevational view of the rotary disc atomizer shown in FIG. 1, mounted in a tilted position to the vertical.

Because of the centrifical force of the swirling liquid during passage through the whirl chamber sleeve 35 and annular disc chamber 41 directs the liquid outwardly against the walls of the respective chambers, while at the same time permitting the liquid to be fed to the tapered dispensing surface of the disc 11, the atomizer 10 of the present invention may be mounted with its axis of rotation vertically disposed as illustrated in FIG. 1, or alternatively, with the axis substantially tilted from the vertical. In FIG. 2, for example, the atomizer is shown with the mounting flange 16 secured to an angled leg 50 of the mounting flange 15 such that the rotary axis of the disc is tilted at an angle to the vertical. With the atomizer mounted at such condition, the spray admitted from the lowermost side of the disc, or the right hand side as viewed in FIG. 2, can be more forcefully directed into foliage while the spray on the opposite side is directed upwardly and will float down on top of the foliage. Because of the liquid feed arrangement of the present invention, the atomizer may be mounted in such tilted position without significantly altering the uniformity of output of the spray about the perimeter of the rotary disc or droplet size, and without undesirable leakage or drippage from the atomizer. Although the atomizer 10 is shown mounted in FIG. 2 at an angle of about 20 degrees to the vertical, it will be understood that it could be mounted at greater angles, including angles up to 90 degrees.

Figure 6:
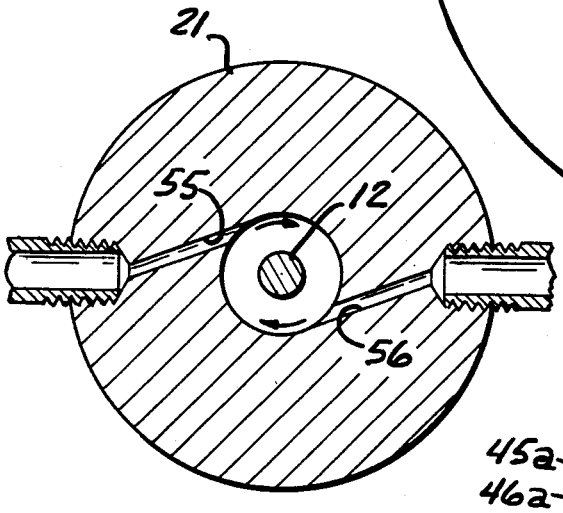
FIG. 6 is a sectional view similar to FIG. 4, but showing an alternative liquid supply feed arrangement.

In carrying out a further aspect of the invention, the liquid supply arrangement is adapted to permit mixing of chemicals simultaneously during the spraying operation. An alternate feed arrangement, for example, is shown in FIG. 6 wherein a pair of liquid supply passages 55, 56 are formed in the mounting block for tangentially feeding separate liquid streams into the whirl chamber from diametrically opposed sides. By separately feeding chemicals, or chemicals and water or other carrier, in such manner, the swirling movement of the liquids in the fixed whirl chamber sleeve 35 and subsequently in the annular disc chamber 41 will cause thorough mixing prior to being fed onto the dispensing surface of the rotary disc. Such procedure is particularly desirable when incompatible chemicals are to be simultaneously applied, or when premixed chemicals cannot be stored for prolonged periods, or when it is simply desirable to eliminate the step of prior mixing.

Figure 7:
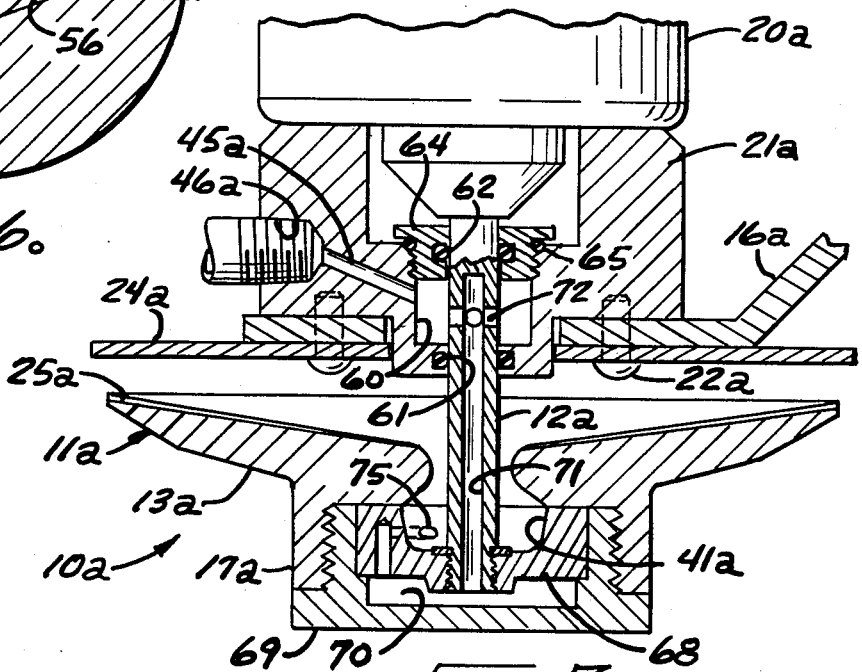
FIG. 7 is a vertical section of an alternative embodiment of rotary disc atomizer embodying the invention.

Referring now to FIG. 7, there is shown an alternative embodiment of atomizer embodying the present invention wherein elements similar to those previously described have been given a similar reference numeral with the distinguishing suffix "a" added. The atomizer 10*a* has a mounting block 21*a* formed with a first fluid supply chamber 60 about the motor driveshaft 12*a*, which is supplied with liquid to be sprayed through an inlet passage 45*a* coupled to the inlet port 46*a*. Since the fluid supply chamber 60 is filled with liquid, as will become apparent, rotary seals 61, 62 are provided on opposite sides of the chamber 60. The rotary seal 62 in this case is carried in a cap 64 which is in in threaded engagement with the mounting block 21*a* for closing the upper end of the chamber 60. An O-ring 65 also is interposed between outer flanges of the cap 64 and the mounting block 21*a*.

The rotary disc 11*a* includes a cone 13*a* and a hub 17*a*, the latter comprising an inner disc 68 coupled to the lowermost end of the motor driveshaft 12*a* and fixed within an end cap 69 that is in threaded engagement with the cone 13*a*. The disc 68 and end cap 69 are formed to define a second fluid supply chamber 70 immediately below the lowermost end of the driveshaft 12*a*. For communicating liquid between the first fluid supply chamber 60 and the second fluid supply chamber 70, the driveshaft 12*a* is formed with an axial port 71 which communicates with the first fluid supply chamber 60 by means of a transverse appeture 72 and is in direct communication at its lower end with the second fluid supply chamber 70.

In carrying out this embodiment of the invention, a fluid supply passage 75 extends from the second fluid supply chamber 70 into tangential relation with the annular disc chamber 41*a*. Pressurized liquid introduced through the fluid supply passage 45*a* will fill the first fluid supply chamber 60, which in turn will feed liquid through the driveshaft ports 72, 71 to fill the second fluid supply chamber 70. Continued pressurized supply of liquid through the passage 45*a* will then forcefully direct liquid through the passage 75 tangentially into the annular disc chamber 41*a* where it is whirled about in a relatively uniform sheet which ultimately feeds through the annular discharge opening 42*a* centrally onto the dispensing surface of the rotary disc 11*a* in a manner similar to that described in the previous embodiment.

The atomizer 10*a* has been found to permit relatively precise control of the droplet size through variation of the pressure of the feed liquid to the port 46*a*. Because of the relatively small diameter fluid inlet passages, and particularly passage 75, such variations in pressure permit spraying of a wide range of droplet sizes with a relatively narrow liquid flow range. It will be appreciated that the liquid flow, and thus droplet size may further be controlled by proper sizing of the fluid passages, and again, particularly the tangential inlet passage 75. It has been found that so long as pressure is sufficient to cause the necessary rapid swirling movement of liquid in the whirl chamber 41*a*, the liquid may be directed either in the same or opposite direction as the disc rotation.

From the foregoing, it can be seen that the rotary disc atomizer of the present invention is adapted for more versatile and precisely controlled spraying of liquids. The atomizer is operable to generate relatively precisely controlled, uniform sized droplets whether mounted in a vertical position or in significantly tilted positions. Moreover, virtue of the novel liquid feed arrangement to the rotary disc, the atomizer may be utilized to eliminate premixing of the chemicals being sprayed.

I claim as my invention:

1. A rotary liquid atomizer comprising of a disc mounted for rotational movement about a central axis and defining a fluid dispensing surface that terminates at the outer periphery of said disc, means for rotatably driving said disc, said disc being formed with a central annular fluid supply chamber having an annular discharge opening in communication with said dispensing surface, means extending into said supply chamber for feeding a controlled uniform thin sheet of liquid whirling in a tangential direction such that said liquid accumulates in rapidly moving uniform fashion about the periphery of said chamber, said annular discharge opening having a diameter less than the diameter of said supply chamber such that when liquid accumulates in said supply chamber to the level of said discharge opening the liquid will exit from said discharge opening centrally onto said dispensing surface in a uniform annular flow for movement in the form of a thin film to the outer periphery thereof by centrifugal forces resulting from the rotation of said disc, said dispensing surface of said disc being formed with a plurality of closely spaced radial grooves extending outwardly from the center of said dispensing surface to the peripheral edge thereof for guiding movement of the liquid to said peripheral edge, whereby said liquid film is discharged from said disc in substantially uniform sized droplets.

2. The atomizer of claim 1 in which said feeding means includes a fixed whirl chamber means having a discharge end extending into said disc fluid supply chamber and means for directing liquid tangentially into said fixed whirl chamber means

3. The atomizer of claim 2 in which said annular whirl chamber means discharge end has a diameter less than the diameter of said supply chamber discharge opening.

4. The atomizer of claim 2 in which said fixed whirl chamber means includes a fixed sleeve mounted in coaxial relation with respect to said disc, and said feeding means includes means for supplying liquid tangentially into said sleeve.

5. The atomizer of claim 4 in which said driving means includes a power driven driveshaft extending through said fixed sleeve and disc supply chamber, and means for coupling said disc to said driveshaft.

6. The atomizer of claim 4 including a mounting block, said drive means including a drive shaft extending through said mounting block for supporting said disc in spaced relation below said mounting block, and said sleeve is supported in depending relation from said mounting block with a lower end thereof extending into said disc supply chamber.

7. The apparatus of claim 6 in which said feeding means includes a passage in said mounting block formed to direct liquid tangentially into said sleeve.

8. The atomizer of claim 7 in which said block passage is formed to direct liquid tangentially and downwardly into said sleeve.

9. The atomizer of claim 6 in which said driveshaft is the depending shaft of a motor mounted on said mounting block.

10. A rotary liquid atomizer comprising of a disc mounted for rotational movement about a central axis and defining a fluid dispensing surface that terminates at the outer periphery of said disc, means for rotatably driving said disc, means defining a liquid supply chamber in coaxial relation to the rotary axis of said disc, said supply chamber having an annular discharge opening, means including a liquid passage with an outlet in the peripheral wall of said supply chamber for tangentially feeding a controlled pressurized stream of liquid into said supply chamber such that liquid accumulates in rapidly moving uniform fashion about the peripheral wall of said supply chamber, said annular discharge opening having a diameter less than the diameter of said supply chamber such that when liquid accumulates in said supply chamber to the level of said discharge opening the liquid will exit from said discharge opening centrally onto said dispensing surface in a uniform annular flow for movement in the form of a thin film to the outer periphery thereof by centrifugal forces resulting from rotation of said disc, whereby said liquid film is discharged from said disc in substantially uniform sized droplets.

11. The atomizer of claim 10 in which said feeding means directs liquid into said supply chamber in a direction that imparts circumferential and axial movement of the liquid within said chamber and out said discharge opening thereof.

12. The atomizer of claim 10 in which said feeding means includes a plurality of liquid passages for simultaneously feeding separate liquid streams into said supply chamber means.

13. The atomizer of claim 10 in which said liquid supply chamber means is an annular chamber formed centrally in said disc.

14. The atomizer of claim 13 in which said driving means includes a power driven driveshaft, means supporting said disc on said driveshaft, and said liquid feeding means supplies pressurized liquid through said driveshaft and then tangentially into said chamber.

15. The atomizer of claim 10 including mounting means for supporting said atomizer with the rotary axis of said disc in predetermined position.

16. The atomizer of claim 15 in which said mounting means supports said atomizer with said disc axis tilted at a substantial angle to the horizontal.

17. The atomizer of claim 10 in which said disc surface is formed with a conical shaped recess.

18. A rotary liquid atomizer comprising of a disc mounted for rotational movement about a central axis and defining a fluid dispensing surface that terminates at the outer periphery of said disc, means for rotatably driving said disc, said disc being formed with annular liquid supply chamber centrally in the top thereof, said supply chamber having a closed bottom and an upper annular discharge opening communicating with said fluid dispensing surface, means for tangentially feeding a pressurized stream of liquid to be atomized into said supply chamber as said disc is rotated such that said liquid accumulates in rapidly moving fashion about the periphery of said chamber, said annular discharge opening having a diameter less than the diameter of said supply chamber such that when liquid accumulates in said supply chamber to the level of said discharge opening the liquid will exit from said discharge opening in a controlled uniform annular flow onto said dispensing surface for movement in the form of a thin film to the outer periphery thereof by centrifugal forces resulting from rotation of said disc, said dispensing surface of said disc being formed with a plurality of closely spaced radial grooves extending outwardly from the center of said dispensing surface to the peripheral edge thereof for guiding movement of the liquid to said peripheral edge, whereby said liquid film is discharged from said disc in substantially uniform sized droplets.

19. The atomizer of claim 18 in which said drive means includes a motor having a depending shaft extending coaxially into said supply chamber, means for coupling said shaft to bottom of said disc supply chamber, and said supply chamber discharge opening having a diameter greater than the diameter of said shaft for permiting the annular flow of liquid through said discharge opening onto said dispensing surface without substantial contact with said shaft.

* * * * *